US011004576B2

(12) United States Patent
Sirin et al.

(10) Patent No.: US 11,004,576 B2
(45) Date of Patent: May 11, 2021

(54) FLAME RETARDANT ELECTRICAL CABLE

(71) Applicant: Prysmian S.p.A., Milan (IT)

(72) Inventors: Zekeriya Sirin, Milan (IT); Serdar Buyuk, Milan (IT)

(73) Assignee: PRYSMIAN S.P.A., Milan (IT)

( * ) Notice: Subject to any disclaimer, the term of this patent is extended or adjusted under 35 U.S.C. 154(b) by 0 days.

(21) Appl. No.: 16/623,738

(22) PCT Filed: Jun. 29, 2017

(86) PCT No.: PCT/EP2017/066154
§ 371 (c)(1),
(2) Date: Dec. 17, 2019

(87) PCT Pub. No.: WO2019/001715
PCT Pub. Date: Jan. 3, 2019

(65) Prior Publication Data

US 2020/0126690 A1 Apr. 23, 2020

(51) Int. Cl.
*H01B 7/295* (2006.01)

(52) U.S. Cl.
CPC ..... *H01B 7/295* (2013.01)

(58) Field of Classification Search
CPC ..... H01B 7/0208; H01B 7/295; H01B 11/04
(Continued)

(56) References Cited

U.S. PATENT DOCUMENTS 4,659,871 A * 4/1987 Smith ..... C08K 9/04
174/113 R
4,869,848 A * 9/1989 Hasegawa ..... H01B 3/44
252/609

(Continued)

FOREIGN PATENT DOCUMENTS

AU 4832685 A 4/1986
EP 0237440 A2 9/1987

(Continued)

OTHER PUBLICATIONS

Kynar, "Kynar® & Kynar Flex® PVDF, Performance Characteristics & Data, Thermoplastics or Engineering Applications," 2007, 20 pages.

(Continued)

*Primary Examiner* — Chau N Nguyen
(74) *Attorney, Agent, or Firm* — Slater Matsil, LLP

(57) ABSTRACT

A flame retardant cable for low-voltage applications is disclosed which comprises at least one conductor individually electrically insulated by a layer of polymeric material, a fire-resistant tape containing an inorganic material wrapped around said at least one individually electrically insulated conductor and an multilayered outer sheath having flame-retardant properties which encloses said at least one individually electrically insulated conductor and said fire-resistant tape, wherein said multilayered outer sheath comprises an inner layer and an outer layer, the inner layer being made of a flame-retardant polymeric material having a limiting oxygen index (LOI) higher than the LOI of the flame-retardant polymeric material forming the outer layer of said sheath. Such a cable has improved flame retardant performances, especially regarding a lower generation of droplets during burning, which render it capable of being certified in higher classes of the current international standards, for example of the European standard EN 50399: 2011/A1 (2016).

16 Claims, 1 Drawing Sheet

(58) Field of Classification Search
USPC ..... 174/120 R, 121 A, 113 R
See application file for complete search history.

(56) References Cited

U.S. PATENT DOCUMENTS

| | | | | |
|---|---|---|---|---|
| 6,392,152 | B1 * | 5/2002 | Mottine, Jr. ..... | H01B 3/441 174/110 PM |
| 7,923,638 | B2 * | 4/2011 | Kaczmarski ..... | H01B 7/187 174/110 R |
| 2002/0001715 | A1 | 1/2002 | Redondo et al. | |
| 2002/0117325 | A1 | 8/2002 | Mennone et al. | |
| 2011/0266052 | A1 * | 11/2011 | Glew ..... | H01B 7/295 174/99 R |
| 2013/0161058 | A1 | 6/2013 | Camp, II et al. | |
| 2014/0291019 | A1 | 10/2014 | Mayer-Rosa et al. | |
| 2016/0233007 | A1 * | 8/2016 | Truong ..... | H01B 13/141 |
| 2016/0377825 | A1 * | 12/2016 | Bringuier ..... | G02B 6/4433 385/113 |

FOREIGN PATENT DOCUMENTS

| | | | |
|---|---|---|---|
| GB | 2170646 | A | 8/1986 |
| WO | WO 2015/040448 | * | 3/2015 |
| WO | 2017097350 | A1 | 6/2017 |

OTHER PUBLICATIONS

Cenelec, "Common test methods for cables under tire conditions-Heat release and smoke production measurement on cables during flame spread test-Test apparatus, procedures, results," European Standard EN 50399:2011/A1:2016, Jun. 2016, 10 pages.

International Standard, "International Electrotechnical Commission, Tests on Electric and Optical Fibre Cables, Under Fire Conditions—Part 3-22: Test for Vertical Flame Spread of Vertically-Mounted Bunched Wires or Cables—Category A," IEC 60332-3-22, Edition 1.1, Feb. 2009, 32 pages.

* cited by examiner

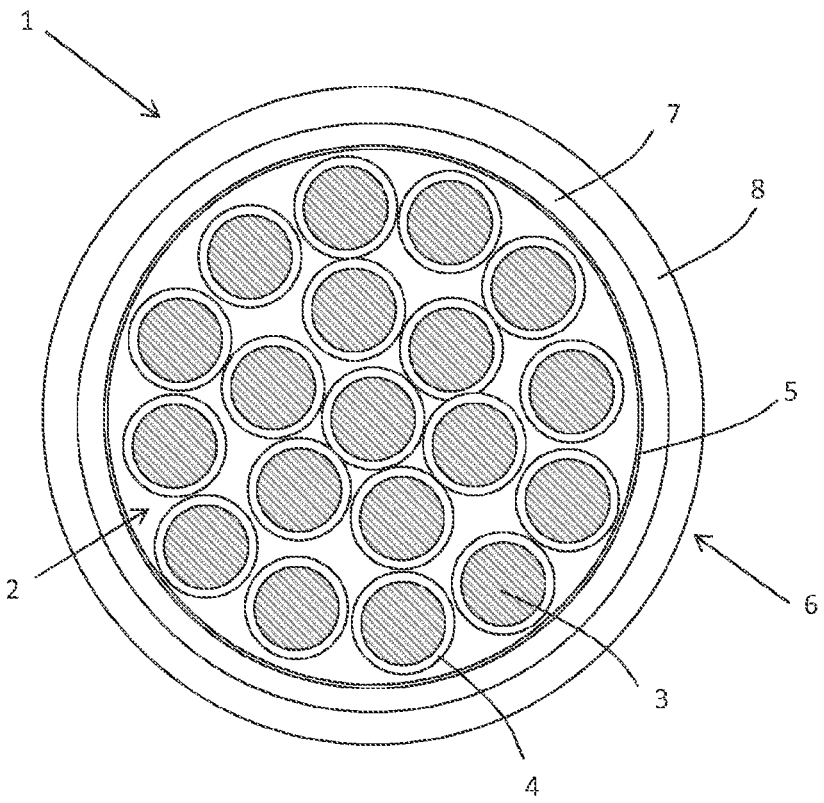
1
7
8
5
2
6
3
4

FLAME RETARDANT ELECTRICAL CABLE

CROSS-REFERENCE TO RELATED APPLICATIONS

This application is a national stage of International Application No. PCT/EP2017/066154, filed on Jun. 29, 2017, which application is hereby incorporated herein by reference in its entirety.

TECHNICAL FIELD

The present invention relates to a flame retardant electrical cable.

In particular, the present invention relates to a flame retardant electrical cable having also low heat release properties which can be used particularly for low-voltage (LV) applications.

BACKGROUND

An important requirement for electric cables is a good behavior in presence of fire (as specified for example in standard IEC 60332-3C), so as to prevent flame and smoke propagation in houses or, more generally, in premises where persons reside.

The flame retardancy of an electric cable can be evaluated for compliance with and certified by national and/or international standards.

It is known that said standards, particularly international standards, require more and more stringent flame retardant and low heat release performances to cables to the end of improving the safety in buildings.

In this connection, an important aspect of the flame retardant performance of a cable is related to the possible generation of droplets derived from the melting of the plastic material forming the electric insulation or the cover sheath when the cable is exposed to flame temperatures and, when droplets are actually generated, to the time span until the droplets end burning.

Currently, many flame retardant cables exhibit performances, particularly in connection with droplets generation during burning, such as they can obtain certification only in lower classes of current international standards, for example of the European standard EN 50399:2011/A1 (2016), or may even not comply with such standard or some of them.

One method for improving the flame retardant performance of a cable is to protect the conductor metal by wrapping on it one or more tapes of an inorganic material, usually mica, placed on a support consisting for example of glass fibers.

However, this method has some drawbacks. For example, mica-containing tape wrapping may give place to gaps around the conductor which may compromise the electric insulation resulting, in the worst cases, in a short circuit.

The presence of flame-retardant layers can help in reducing the flame propagation in a cable, for example an outer sheath made of zero-halogen polymer compounds mixed with flame-retardant inorganic fillers (also known as low smoke zero halogen material, "LSoH" or "LSZH").

However, high contents of fillers are required in the outer sheath for obtaining suitable flame-retardant properties which results in poor mechanical properties for the final cable.

GB 2170646 discloses a multiconductor electric cable comprising a bundle of electrical conductors each of which is electrically insulated from each other conductor by means only of an extruded insulating coating of a polymeric material that leaves an electric insulating residue on combustion. The bundle of insulated electric conductors is enclosed by one or more wrapped mineral tapes and the bundle and tape(s) are enclosed in a cable jacket. The jacket is based on ethylene copolymer elastomer with a flame-retardant filler.

US Patent Publication 2002/0117325 discloses an electric cable that is capable of resisting flame temperatures. The cable comprises an electrical conductor held within a tubular member formed of a heat insulation material, preferably a silicone elastomeric material. The insulated conductor is surrounded by a shield layer made of a high-temperature material such as a mica tape. A jacket is provided enclosing the insulated conductor and the shield layer which is made of a non-halogenated thermoplastic material including suitable flame retardants, such as magnesium hydroxide.

US Patent Publication 2013/0161058 discloses a cable that comprises a core that has at least one conductor, a dielectric barrier layer that surrounds the core, and a conductive shield that surrounds the core. The dielectric barrier layer is formed of a non-flammable material including mica tapes. The barrier layer may be coated with a flame-retardant material, that is preferably LSZH to further aid the burn performance of the barrier layer. An outer jacket may surround the core, barrier layer and shield. The outer jacket may be formed of any conventional insulation material, such as PVC.

US Patent Publication 2014/0291019 discloses a power line comprising multiple cores, wherein each core has a core insulation and all core insulations are enclosed by a common sheath, and the sheath is surrounded by an oversheath. The core insulations comprise a material which is selected from the group consisting of polyalkylenes. The sheath comprises a material, which is selected from the group consisting of polyvinyl chloride, thermoplastic polyester elastomers, thermoplastic copolyesters.

The technical problem faced by the present invention is thus that of providing an electric cable, in particular a low-voltage electric cable, having improved flame retardancy performances so as to meet the more stringent requirements for certification according to the current international standards, for example of the European standard EN 50399:2011/A1 (2016), in a class of such standards as high as possible, while showing good mechanical properties.

SUMMARY

An electric cable having a core comprising at least one conductor individually electrically insulated by a polymeric layer, a fire-resistant tape comprising inorganic material and wrapped around the core and a multilayered sheath surrounding the fire-resistant tape and comprising an inner layer and an outer layer, both made of a low smoke zero halogen (LSoH) flame-retardant polymeric material, the LSoH flame-retardant polymeric material of the inner layer having a limiting oxygen index (LOI) higher than the LOI of the LSoH flame-retardant polymeric material of the outer layer.

An electric cable comprising a core comprising a conductor electrically insulated by a polymeric layer; a fire-resistant tape comprising inorganic material and wrapped around the core; and a multilayered sheath surrounding the fire-resistant tape, the multilayered sheath comprising an inner layer and an outer layer, both made of a low smoke zero halogen (LSoH) flame-retardant polymeric material, the LSoH flame-retardant polymeric material of the inner layer having a limiting oxygen index (LOI) higher than the LOI of the LSoH flame-retardant polymeric material of the outer layer.

An electric cable comprising a core comprising a plurality of conductors and a plurality of polymeric layer, where each of the plurality of conductors is electrically insulated from an adjacent one of the plurality of conductors by the plurality of polymeric layers; a fire-resistant tape comprising inorganic material and wrapped around the core; and a multilayered sheath surrounding the fire-resistant tape. The multilayered sheath comprises an inner layer and an outer layer exposed to an outside environment, where the multilayered sheath is made of a low smoke zero halogen (LSoH) flame-retardant polymeric material, the LSoH flame-retardant polymeric material of the inner layer having a limiting oxygen index (LOI) higher than the LOI of the LSoH flame-retardant polymeric material of the outer layer.

BRIEF DESCRIPTION OF THE DRAWINGS

FIG. 1 illustrates a cross-sectional view of a cable in accordance with embodiments of the present invention.

DETAILED DESCRIPTION OF ILLUSTRATIVE EMBODIMENTS

The Applicant found that an electric cable has improved flame retardant and reduced heat release properties when its conductors are collectively surrounded by one mica tape (as fire barrier), a LSoH inner sheath having a high oxygen index and a LSoH outer sheath having a lower oxygen index.

Accordingly, embodiments of the present invention relates to an electric cable having a core comprising at least one conductor individually electrically insulated by a polymeric layer, a fire-resistant tape comprising inorganic material and wrapped around the core, and a multilayered sheath surrounding the fire-resistant tape and comprising an inner layer and an outer layer, both made of a LSoH flame-retardant polymeric material, the LSoH material of the inner layer having a limiting oxygen index (LOI) higher than the LOI of the LSoH material of the outer layer.

According to a preferred embodiment of the invention, the inner layer of the sheath is made of a LSoH flame-retardant polymeric material having a LOI higher than 70% and the outer layer of the sheath is made of a LSoH flame-retardant polymeric material having a LOI from 30% to 70%.

The Applicant has surprisingly found that a cable having the combination of the features mentioned above has improved flame retardant and low heat release performances, especially regarding a lower generation of droplets during burning, which render the cable of the invention capable of being certified in higher classes of the current international standards, for example of the Commission Delegated Regulation (EU) 2016/364 of 1 Jul. 2015. In addition, it has been found that the provision of a multilayered sheath wherein the inner layer is made of a LSoH flame-retardant polymeric material having a LOI higher than the LOI of the flame-retardant polymeric material of the outer layer allows to impart improved flame-retardant properties to the cable without impairing its mechanical properties, particularly in terms of tensile strength and elongation at break, even after thermal ageing, and workability of the sheath, for example through conventional extrusion techniques.

Within the present description and the subsequent claims, the limiting oxygen index (LOI) is the minimum concentration of oxygen, expressed as percentage, that supports combustion of a polymer in case of fire.

Higher values of LOI indicate greater fire retardancy. LOI values are determined by standardized tests, such as ASTM D2863-12 (2012).

For the purpose of the present description and of the claims that follow, except where otherwise indicated, all numbers expressing amounts, quantities, percentages, and so forth, are to be understood as being modified in all instances by the term "about". Also, all ranges include any combination of the maximum and minimum points disclosed and include any intermediate ranges therein, which may or may not be specifically enumerated therein.

In the cable according to the invention, the conductor is an element of elongate shape made of an electrically conductive material, e.g. aluminium or copper or composite thereof. The conductor may be in the form of a solid bar or a bundle of wires, preferably stranded.

In the cable of the invention, the core preferably comprises a plurality of conductors individually electrically insulated by a polymeric layer.

Each conductor of the cable of the invention is electrically insulated by a polymeric layer (hereinafter also referred to as "insulating layer"). The polymeric material of the insulating layer may be any polymeric material having electric insulating properties which is either cross-linked or not cross-linked.

The polymeric material of the insulating layer can be selected, for instance, from: polyolefins, (homopolymers or copolymers of different olefins), copolymers ethylene/unsaturated esters, polyesters and mixtures thereof. Examples of insulating polymeric material are polyethylene (PE), particularly low density polyethylene (LDPE) and linear low-density PE (LLDPE), polypropylene (PP), thermoplastic copolymers propylene/ethylene; elastomeric copolymers ethylene/propylene (EPR) or ethylene-propylene-diene (EPDM); copolymers ethylene/vinylacetate (EVA); copolymers ethylene/methylacrilate (EMA); copolymers ethylene/ethylacrylate (EEA); copolymers ethylene/butylacrylate (EBA); copolymers ethylene/$\alpha$-olefin, and the like.

Preferably, the polymeric material of the insulating layer is chosen from the group consisting of polyethylene (PE), linear low-density PE (LLDPE), and copolymers ethylene/vinylacetate (EVA), and mixture thereof.

The polymeric material of the insulating layer, e.g. PE, is preferably cross-linked. When the cable of the present invention is a telecommunication cable, the polymeric material e.g. PE, is preferably not cross-linked.

The polymeric material of the insulating layer may be filled with flame-retardant fillers so that the electrically insulating layer can also have flame-retardant properties. However, the electrically insulating layer is preferably neither fire-resistant nor flame-retardant.

The core of cable according to the invention, comprising one or, preferably, a plurality of insulated electric conductors, is surrounded by a fire-resistant tape containing an inorganic material.

Preferably, the inorganic material of the fire-resistant tape is chosen from glass fiber, mica and their combination. More preferably, the inorganic material is mica.

The fire-resistant tape is formed preferably by a layer of inorganic material such as mica, attached to a supporting (or backing) layer. The backing layer may be formed of a supporting fabric such as e.g. woven glass and/or glass cloth. Mica, preferably in form of flakes, may be bonded to the backing layer using a binding agent such as, e.g., silicone resin or elastomer, acrylic resin and/or epoxy resin.

When comprising a layer of inorganic material attached to a backing layer, the fire-resistant tape is preferably wrapped around the cable core of the invention so that the inorganic material layer faces the insulated conductor(s) to be protected from fire.

Preferably, the fire-resistant tape is wrapped around the cable core with an overlap equal to or higher than 20%, or preferably higher than 30%.

In the cable of the invention, more than one fire-resistant tape may be wrapped around the individually electrically insulated conductor(s). When two or more fire-resistant inorganic material tapes are present, they are preferably wrapped with opposed winding directions.

Preferably, the cable of the invention comprises a single fire-resistant tape.

The cable according to the invention further includes a flame-retardant multilayered sheath surrounding and, preferably, in direct contact with the fire-resistant tape. The sheath comprises an inner layer and an outer layer, both made of low smoke zero-halogen (LSoH) polymeric compositions including a polymer base mixed with inorganic-flame retardant fillers.

The polymer base in the sheath can be selected from: polyethylene; copolymers of ethylene with at least one α-olefin containing from 3 to 12 carbon atoms, and optionally with at least one diene containing from 4 to 20 carbon atoms; polypropylene; thermoplastic copolymers of propylene with ethylene and/or at least one α-olefin containing from 4 to 12 carbon atoms; copolymers of ethylene with at least one ester selected from alkyl acrylates, alkyl methacrylates and vinyl carboxylates, wherein the alkyl and the carboxylic groups comprised therein are linear or branched, and wherein the linear or branched alkyl group may contain from 1 to 8, preferably from 1 to 4, carbon atoms, while the linear or branched carboxylic group may contain from 2 to 8, preferably from 2 to 5, carbon atoms; and mixtures thereof.

With "α-olefin" it is generally meant an olefin of formula CH2=CH—R, wherein R is a linear or branched alkyl having from 1 to 10 carbon atoms. The α-olefin can be selected, for example, from propylene, 1-butene, 1-pentene, 4-methyl-1-pentene, 1-hexene, 1-octene, 1-dodecene and the like. Among them, propylene, 1-butene, 1-hexene and 1-octene are particularly preferred.

Examples of polymer materials that may be used in the sheath of the cable of the invention are: high-density polyethylene (HDPE) (d=0.940-0.970 g/cm3), medium-density polyethylene (MDPE) (d=0.926-0.940 g/cm3), low-density polyethylene (LDPE) (d=0.910-0.926 g/cm3); linear low-density polyethylene (LLDPE) and very-low-density polyethylene (VLDPE) (d=0.860-0.910 g/cm3); polypropylene (PP); thermoplastic copolymers of propylene with ethylene; ethylene/vinyl acetate (EVA) copolymers; ethylene/ethyl acrylate (EEA) copolymers, ethylene/butyl acrylate (EBA) copolymers; ethylene/α-olefin rubbers, in particular ethylene/propylene rubbers (EPR), ethylene/propylene/diene rubbers (EPDM); and mixtures thereof.

Preferably, the inorganic flame-retardant filler is selected from: metal hydroxides, hydrated metal oxides, metal salts having at least one hydroxyl group, and hydrated metal salts; particularly, the flame-retardant filler is a calcium, aluminium, magnesium or zinc hydroxide, hydrated oxide, salt having at least one hydroxyl group or hydrated salt.

Examples of inorganic hydrated flame-retardant fillers which may be used in the outer sheath of the cable of the invention are: magnesium hydroxide, alumina trihydrate, hydrated magnesium carbonate, hydrated calcium, magnesium carbonate, or mixtures thereof. Magnesium hydroxide is particularly preferred, since it is characterized by a decomposition temperature of about 340° C. and thus allows high extrusion temperatures to be used. It is more particularly preferred to use magnesium hydroxide of natural origin, obtained by grinding minerals based on magnesium hydroxide, such as brucite or the like, as described, for example, in WO2007/049090.

The flame-retardant filler is generally used in the form of particles which are untreated or surface-treated with saturated or unsaturated fatty acids containing from 8 to 24 carbon atoms, or metal salts thereof, such as, for example: oleic acid, palmitic acid, stearic acid, isostearic acid, lauric acid; magnesium or zinc stearate or oleate; and the like. In order to increase the compatibility with the polymer material, the flame-retardant filler can likewise be surface-treated with suitable coupling agents, for example short chain organic silanes or titanates such as vinyltriethoxysilane, vinyltriacetylsilane, tetraisopropyl titanate, tetra-n-butyl titanate and the like.

In accordance with an aspect of the present invention, the inner layer of the multilayered sheath is made of a LSoH flame-retardant polymeric material having a high limiting oxygen index (LOI), higher than 70%, preferably from 75% to 90%, suitable to confer adequate flame-retardant properties to the cable. In accordance with another aspect of the present invention, the outer layer of the multilayered sheath is made of a LSoH flame-retardant polymeric material having a LOI lower than that of the inner layer, comprised of from 30% to 70%, preferably from 30% to 50%.

This can be achieved by varying the amount of inorganic flame-retardant filler mixed to the polymer base which will be greater in the flame-retardant polymeric material forming the inner layer of the sheath and lower in the polymeric material forming the outer layer of the sheath In particular, according to the present invention, the amount of the flame-retardant filler in the polymeric material of the inner layer of the outer sheath can be higher than 500 phr, preferably from 600 phr to 850 phr, so as to obtain adequate flame-retardant properties (LOI higher than 70%). The amount of the flame-retardant filler in the polymeric material of the outer layer of the sheath is maintained lower than the amount of the flame-retardant filler in the polymeric material of the inner layer. In particular, the amount of the flame-retardant filler in the polymeric material of the outer layer is lower than 500 phr, preferably from 150 phr to 300 phr.

Within the present description and the claims, the term "phi" (acronym of "parts per hundred of rubber") is used to indicate parts by weight per 100 parts by weight of the polymer base material.

The inner layer and the outer layer are preferably in direct contact one another.

As known high contents of inorganic flame-retardant fillers as those present in the inner layer of the outer sheath usually lead to a reduction in workability and to an impairment of the mechanical and elastic properties of the resulting mixture (base polymer+inorganic filler). However, it has been surprisingly found that the combination of an inner layer having high contents of inorganic flame-retardant fillers, suitable to obtain desirable flame-retardant properties, and an outer layer having lower contents of inorganic flame-retardant fillers, which alone would not able to provide flame-retardant properties suitable for some international standards, allows to restore appropriate mechanical and elastic properties to the resulting multilayer sheath.

As a result, thanks to the features of its sheath multilayered structure, the cable of the invention advantageously shows high performances during fire in compliance with the requirements of relevant international standards as well as good mechanical properties, particularly in terms of tensile strength and elongation at break and workability in spite of the high content of inorganic fillers in the sheath.

In addition, without being bound to any scientific theory, it is believed that the above-mentioned flame-retardant sheath with multilayered structure also contributes synergistically in improving the fire-resistant performances of the underlying fire-resistant layer (e.g. a mica tape) which results in particular in a reduction (or even absence) of generation of droplets due to the melting of the plastic material forming the electric insulation of the conductor(s) during a fire.

As a result, the cable of the invention has advantageously improved flame retardant performances which render it capable of being certified in higher classes of the current international standards, for example of the European standard EN 50399:2011/A1 (2016).

The production of the cable according to the invention can be carried out by conventional techniques. For example, each insulation layer can be applied over the relevant conductor by conventional plastic material extrusion processes, while the fire-resistant tape can be wrapped around the cable core by conventional winding machines. In addition the multilayered sheath including an inner layer and an outer layer can be applied to surround the fire-resistant tape through conventional plastic material extrusion processes too. For example, it can be applied by means of the "tandem" technique, in which two separate extruders arranged in series are used for applying the inner layer and subsequently the outer layer, or by co-extruding the inner layer and the outer layer.

The flame retardant cable of the present invention can be used for the transportation of electrical energy or data. When the cable of the present invention is an electrical cable, preferably said electrical cable is a cable for the transportation of low-voltage (LV) electrical currents, i.e. electrical currents of voltages equal to o lower than 1 KV.

Further details will be illustrated in the following detailed description, with reference to the appended FIG. 1 which is a cross-section view of a flame retardant cable according to the present invention for power transmission at low voltage.

With reference to FIG. 1, a flame retardant cable according to the invention is denoted, as a whole, by the reference number 1. The cable 1 comprises a cable core 2 comprising a plurality of electric conductors 3 which are individually electrically insulated with a insulating layer 4. In the present embodiment, the electric conductors 3 are made of copper. The insulating layer 4 is made of an electrically insulating cross-linked polyethylene which is neither fire-resistant nor flame-retardant, in that it does not contain any either fire-resistant or flame-retardant filler.

The cable 1 also comprises a single fire-resistant tape 5 of a fire-resistant inorganic material, particularly mica, wrapped around the cable core 2.

Furthermore, the cable 1 includes a multilayered sheath 6 surrounding and in contact with the fire-resistant tape 5. The sheath 6 comprises an inner layer 7 and an outer layer 8 both made of a LSoH polymeric material, such as ethylene polymers, copolymers or mixture thereof, filled with flame-retardant inorganic materials such as magnesium hydroxide.

In the cable of FIG. 1, the inner layer 7 comprises a LSoH polymeric material having a LOI of 88% whereas the outer layer 8 comprises a LSoH polymeric material having a LOI of 36%.

The embodiments of the present invention will now be described by means of the results of tests under fire conditions which were carried out on some electrical cables according to the embodiments of the present invention.

The set-up used for the tests under fire conditions is substantially that specified in the European standard EN 50399:2011/A1 (2016) and IEC 61034-2 (2005), which, according to the Table 4 of the Commission Delegated Regulation (EU) 2016/364 of 1 Jul. 2015, allows to determine, inter alia, the following parameters: Flame Spread (FS), Heat Release Rate (HRR), Total Heat Release (THR), Smoke Production Rate (SPR), smoke density (light transmittance), Total Smoke Production (TSP), Fire Growth Rate Index (FIGRA) and persistence of flaming droplets.

Cable A: A cable according to an exemplary embodiment of the invention and designed like cable 1 of FIG. 1 was a N2XH comprising a core of 19 electric conductors with cross-sectional area of 1.5 $mm^2$ surrounded and in contact with an insulating layer made of non-flame-retardant/non-fire resistant cross-linked polyethylene (XLPE). A single mica tape was wound around the core with a 20% overlap was surrounded and in contact with a sheath made of:—an inner layer of flame-retardant LSoH polymeric material having a LOI of 88%;—an outer layer of flame-retardant LSoH polyolefin compound having a LOI of 36%.

Cable B: The structure of this cable according to another exemplary embodiment of the invention was as that of Cable A, but the cable core comprised 40 conductors having a cross-sectional area of 1.5 $mm^2$.

During the test, all the above cables were subjected to a flame test with 20.5 kW propane/air ignition source for 20 minutes.

The results of the tests are shown in the following Table 1.

TABLE 1

| Cable | FS (m) | THR (MJ) | Peak HRR (KW) | FIGRA (W/s) | TSP ($m^2$) | Peak SPR ($m^2/s$) | Smoke Density (%) | Flaming Droplet Persistence (sec.) |
|---|---|---|---|---|---|---|---|---|
| A | 0.58 | 4.7 | 7.4 | 19.8 | 0 | 0 | 92.18 | 0 |
| B | 0.52 | 3.8 | 6.7 | 20.3 | 0 | 0 | 78.85 | 6 |

From the above results, both cable A and B according to the invention qualified as B2 (low fire hazard cable) according to Table 4 of the Commission Delegated Regulation (EU) 2016/364 as having FS (Flame Spread)≤1.5 m; THR (Total Heat Release)≤15 MJ; Peak HRR (Heat Release Rate)≤30 kW; and FIGRA (Fire Growth Rate Index)≤150 W/s.

In addition, Cable A qualified as s1*a* (little production and slow propagation of smoke; high visibility) according to Table 4 of the Commission Delegated Regulation (EU) 2016/364 because TSP (Total Smoke Production)≤50 m2, Peak SPR (Smoke Production Rate)≤0.25 m2/s and smoke density (in terms of light transmittance in accordance with EN 61034-2)≥80%; while Cable B qualified as sib (little production and slow propagation of smoke; good visibility) because TSP (Total Smoke Production)≤50 m2, Peak SPR (Smoke Production Rate)≤0.25 m2/s and smoke density (in terms of light transmittance in accordance with EN 61034-

2)≤60%<80%. Without wishing to be bound to a theory, the different behavior between the two cables of the invention could be due to the number of conductors contained in their cores: the number of conductors in cable B (more than the double of that of cable A) could have caused a lower light transmittance, though out of the requirement of s1*a* of less than 2%.

Possibly for the same reason above, Cable A qualified as do as flaming droplet persistence (no flaming droplets/particles within 1.200 s) according to Table 4 of the Commission Delegated Regulation (EU) 2016/364, while Cable B qualified as d1 (no flaming droplets/particles persisting longer than 10 s within 1.200 s).

Both the tested cables qualified to be suitable for areas with very high fire risks, for example underground railways.

The invention claimed is:

1. An electric cable having a core comprising:

at least one conductor individually electrically insulated by a polymeric layer;

a fire-resistant tape comprising inorganic material and wrapped around the core; and a multilayered sheath surrounding the fire-resistant tape and being the outermost sheath of the cable, the multilayered sheath comprising an inner layer and an outer layer, both made of a low smoke zero halogen (LSoH) flame-retardant polymeric material including a base polymer mixed with inorganic flame-retardant fillers, the LSoH flame-retardant polymeric material of the inner layer having a limiting oxygen index (LOI) higher than the LOI of the LSoH flame-retardant polymeric material of the outer layer, the LOI of the inner layer being higher than 70% and the LOI of the outer layer being between 30% and 70%.

2. The cable according to claim 1, wherein the at least one conductor comprises a plurality of conductors individually electrically insulated by a polymeric layer.

3. The cable according to claim 1, wherein the polymeric layer is neither fire-resistant nor flame-retardant.

4. The cable according to claim 1, wherein the inorganic material of the fire-resistant tape is chosen selected from glass fiber, mica and their combination.

5. The cable according to claim 1, wherein the fire-resistant tape is a single fire-resistant tape.

6. The cable according to claim 1, wherein the inner layer is made of a LSoH flame-retardant polymeric material having a LOI between 75% and 90%.

7. The cable according to claim 1, wherein the inorganic material of the fire-resistant tape is mica.

8. An electric cable comprising:

a core comprising a conductor electrically insulated by a polymeric layer;

a mica tape wrapped around the core; and a multilayered sheath surrounding the mica tape and being the outermost sheath of the cable, the multilayered sheath comprising an inner layer and an outer layer, both made of a low smoke zero halogen (LSoH) flame-retardant polymeric material including a base polymer mixed with inorganic flame-retardant fillers, the LSoH flame-retardant polymeric material of the inner layer having a limiting oxygen index (LOI) higher than the LOI of the LSoH flame-retardant polymeric material of the outer layer, the LOI of the inner layer being between 75% and 90% and the LOI of the outer layer being between 30% and 50%.

9. The cable according to claim 8, wherein the core further comprises a plurality of conductors and a plurality of polymeric layers, wherein each of the plurality of conductors is individually electrically insulated by a corresponding one of the plurality of polymeric layers.

10. The cable according to claim 8, wherein the polymeric layer is not fire-resistant.

11. The cable according to claim 8, wherein the polymeric layer is not flame-retardant.

12. The cable according to claim 8, wherein the mica tape is a single fire-resistant tape.

13. An electric cable comprising:

a core comprising a plurality of conductors and a plurality of polymeric layer, wherein each of the plurality of conductors is electrically insulated from an adjacent one of the plurality of conductors by the plurality of polymeric layers;

a fire-resistant tape comprising inorganic material and wrapped around the core; and a multilayered sheath surrounding the fire-resistant tape and being the outermost sheath of the cable, the multilayered sheath comprising an inner layer and an outer layer exposed to an outside environment, wherein the multilayered sheath is made of a low smoke zero halogen (LSoH) flame-retardant polymeric material including a base polymer mixed with inorganic flame-retardant fillers, the LSoH flame-retardant polymeric material of the inner layer having a limiting oxygen index (LOI) higher than the LOI of the LSoH flame-retardant polymeric material of the outer layer, the LOI of the inner layer being higher than 70% and the LOI of the outer layer being between 30% and 70%.

14. The cable according to claim 13, wherein the polymeric layer is neither fire-resistant nor flame-retardant.

15. The cable according to claim 13, wherein the inorganic material of the fire-resistant tape is a material selected from the group consisting of glass, fiber, and mica.

16. The cable according to claim 13, wherein the fire-resistant tape is a single fire-resistant tape.

* * * * *